US006045327A

United States Patent [19]

Amr

[11] Patent Number: 6,045,327

[45] Date of Patent: Apr. 4, 2000

[54] AXIAL FLOW FAN ASSEMBLY AND ONE-PIECE HOUSING FOR AXIAL FLOW FAN ASSEMBLY

[75] Inventor: Yehia M. Amr, Manlius, N.Y.

[73] Assignee: Carrier Corporation, Farmington, Conn.

[21] Appl. No.: 09/072,110

[22] Filed: May 4, 1998

[51] Int. Cl.[7] ..... F01D 1/02

[52] U.S. Cl. ..... 415/211.2; 415/191; 415/210.1; 415/220; 416/189; 416/237

[58] Field of Search ..... 415/211.2, 220, 415/223, 210.1, 208.2, 191; 416/169 A, 189, 237

[56] References Cited

U.S. PATENT DOCUMENTS

| | | | |
|---|---|---|---|
| 4,358,265 | 11/1982 | Gray . | |
| 4,569,632 | 2/1986 | Gray, III . | |
| 4,927,324 | 5/1990 | Coup et al. | 415/121.2 |
| 5,066,194 | 11/1991 | Amr et al. | 415/223 |
| 5,215,438 | 6/1993 | Chou et al. . | |
| 5,246,339 | 9/1993 | Bengtsson et al. | 415/208.1 |
| 5,273,400 | 12/1993 | Amr . | |
| 5,342,167 | 8/1994 | Rosseau | 415/119 |
| 5,511,942 | 4/1996 | Meier | 415/220 |

FOREIGN PATENT DOCUMENTS 2178798 2/1997 United Kingdom .

*Primary Examiner*—Edward K. Look
*Assistant Examiner*—Ninh Nguyen
*Attorney, Agent, or Firm*—Wall Marjama Bilinski & Burr

[57] ABSTRACT

An axial flow fan assembly including a housing, a stator, a motor supported by the stator, and a fan rotatably mounted on the motor. The stator is connected to the housing at an outlet end thereof, and includes a stator hub and a plurality of stator vanes each extending radially inwardly and axially downwardly from the housing. Each stator vane is connected at its inner tip to the stator hub. The motor is positioned within the housing and is supported by the stator hub. The fan is secured to the shaft of the motor, and includes a fan hub and a plurality of fan blades extending substantially radially outwardly from the fan hub. The particular configuration of the stator vanes allows the entire length of the motor casing to be encompassed between the inlet of the housing and the stator hub, which in turn provides a substantial reduction of the overall axial height of the fan assembly. The stator vanes also allow increased spacing between the fan blades and the stator vanes, which in turn reduces interaction between the fan blades and stator vanes. This reduces the level of noise generated by the fan.

6 Claims, 4 Drawing Sheets

AXIAL FLOW FAN ASSEMBLY AND ONE-PIECE HOUSING FOR AXIAL FLOW FAN ASSEMBLY

BACKGROUND OF THE INVENTION

The present invention relates to an axial flow fan assembly of the type that includes a substantially cylindrical housing, stator vanes positioned at the exit end of the housing, and a rotating fan positioned at the other end of the housing. One example of a prior art fan assembly of this type is described in Chou U.S. Pat. No. 5,215,438, the entirety of which is incorporated herein by reference. The fan assembly described in Chou is depicted in FIG. 7, and includes a housing 130 having a stator 120 positioned at the outlet end of the housing and a rotating fan 110 positioned at the inlet end of the housing. A motor 131 is supported by and suspended from the stator, and a shaft of the motor drives the fan.

The overall axial height of any fan assembly is an important design consideration, in that the axial height of the fan assembly is a major contributing factor to the overall axial height of the system in which the fan assembly is incorporated. In the prior art fan assembly depicted in FIG. 7, the overall axial height of the fan assembly tends to be relatively large, because the motor is supported almost entirely outside the fan assembly housing.

The distance between the fan blades and the vanes of the stator also is an important design consideration to avoid interaction between the two, which would otherwise increase fan noise. In the prior art fan assembly depicted in FIG. 7, the distance between the fan blades and stator vanes is less than one fan blade chord length, which causes increased fan noise.

It would be desirable to decrease the overall axial height of the fan assembly in order to allow use of the assembly in more compact systems (e.g., refrigeration systems for refrigerated vehicles). It also would be desirable to increase the axial distance between the fan blades and the stator vanes in order to reduce the amount of noise generated by the fan assembly.

SUMMARY OF THE INVENTION

It is an object of the invention to provide an axial flow fan assembly that is axially compact and provides maximum axial spacing between the fan blades and the stator vanes.

It is another object of the invention to provide a one-piece housing for an axial flow fan assembly that provides for a reduction in the overall axial height of the fan assembly and provides for increased axial spacing between the fan blades and the stator vanes.

The axial flow fan assembly of the invention includes a housing, a stator formed integrally with the housing, a motor supported by the stator, and a fan rotatably mounted on the motor. The housing has an inlet at one end thereof and an outlet at the other end thereof. The stator is connected to the housing at the outlet end, and includes a stator hub and a plurality of stator vanes each extending radially inwardly and axially downwardly from the housing and each being connected at its inner tip to the stator hub. The motor has a casing with a first end and an opposed second end, and a shaft extending from the first end. The motor is positioned within the housing such that the second end thereof is supported by the stator hub and the first end thereof extends toward the inlet of the housing. The fan is secured to the shaft of the motor, and includes a fan hub and a plurality of fan blades extending substantially radially outwardly from the fan hub.

The particular configuration of the stator vanes allows the entire length of the motor casing to be encompassed between the inlet of the housing and the stator hub, which in turn provides a substantial reduction in the overall axial height of the fan assembly. This allows the fan assembly to be used in systems where overall system size is important.

Additionally, the downwardly extending nature of the stator vanes allows increased spacing between the fan blades and the stator vanes, which in turn reduces interaction between the fan blades and stator vanes. This reduces the noise generated by the fan.

These and other objects of the present invention will be better understood by reading the following detailed description in combination with the attached drawings of a preferred embodiment of the invention.

DETAILED DESCRIPTION OF THE PREFERRED EMBODIMENT

Figure 1:
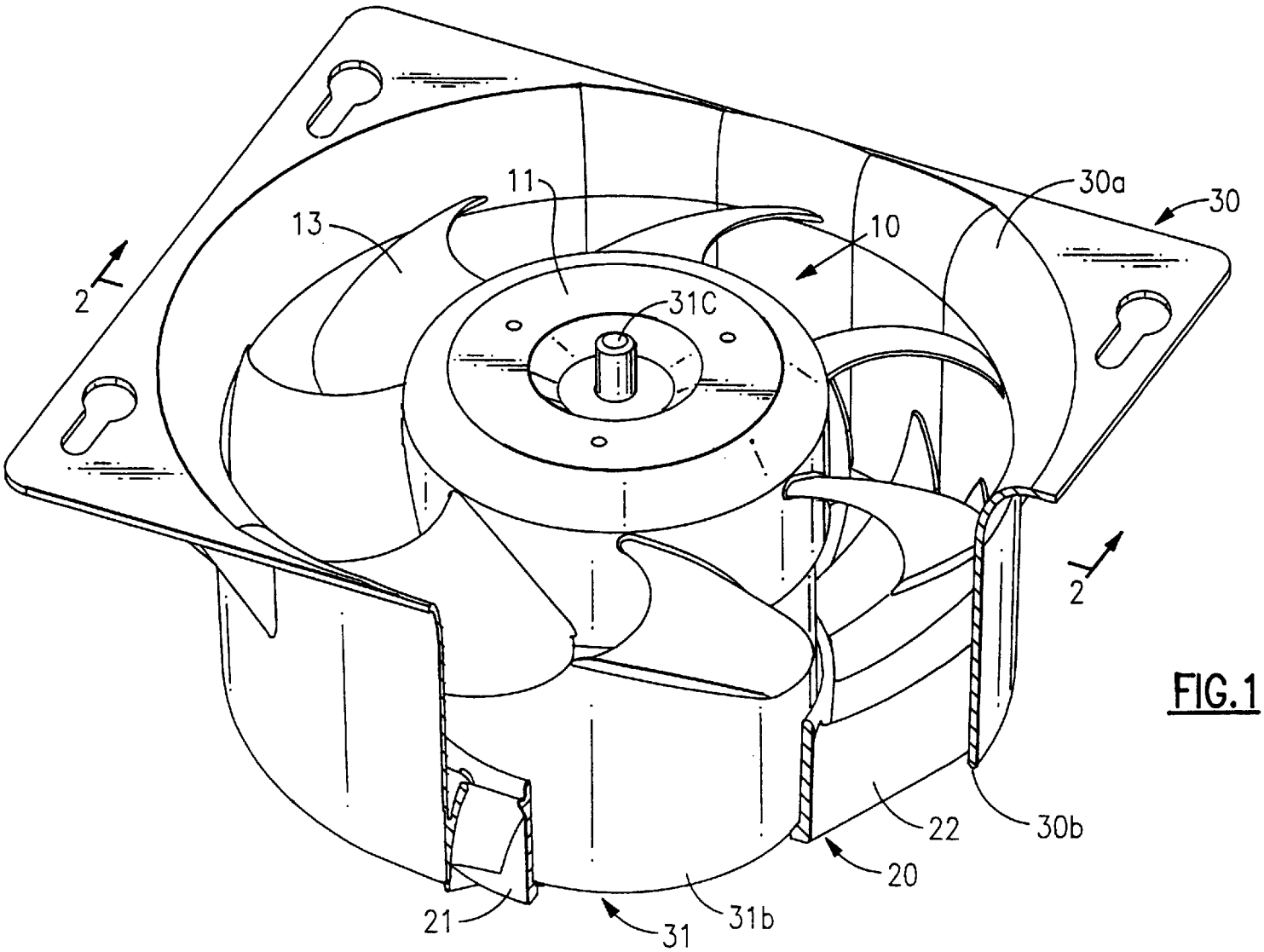
FIG. 1 is a partial sectional view of an axial flow fan assembly according to the invention.

FIG. 1 is a partial sectional view of an axial flow fan assembly according to the invention. The assembly includes a housing 30, a stator 20, a motor 31 supported by stator 20, and a fan 10 rotatably mounted on motor 31. Housing 30 has an inlet 30*a* at one end thereof and an outlet 30*b* at the other end thereof. Stator 20 is connected to housing 30 at outlet end 30*b*, and preferably is formed integrally with housing 30. Stator 20 includes a stator hub 21 and a plurality of stator vanes 22 each extending radially inwardly and axially downwardly from housing 30. Each stator vane 22 is connected at its inner tip to stator hub 21. Motor 31 has a casing with a first end (hidden by fan 10) and an opposed second end 31*b*. A shaft 31*c* extends from the first end to receive fan 10 secured thereto. Motor 31 is positioned within housing 30 such that second end 31*b* is supported by stator hub 21 and the first end thereof extends toward inlet 30*a* of housing 30. Fan 10 is secured to shaft 31*c* of motor 31, and includes a fan hub 11 and a plurality of fan blades 13 extending substantially radially outwardly from fan hub 11.

Figure 2:
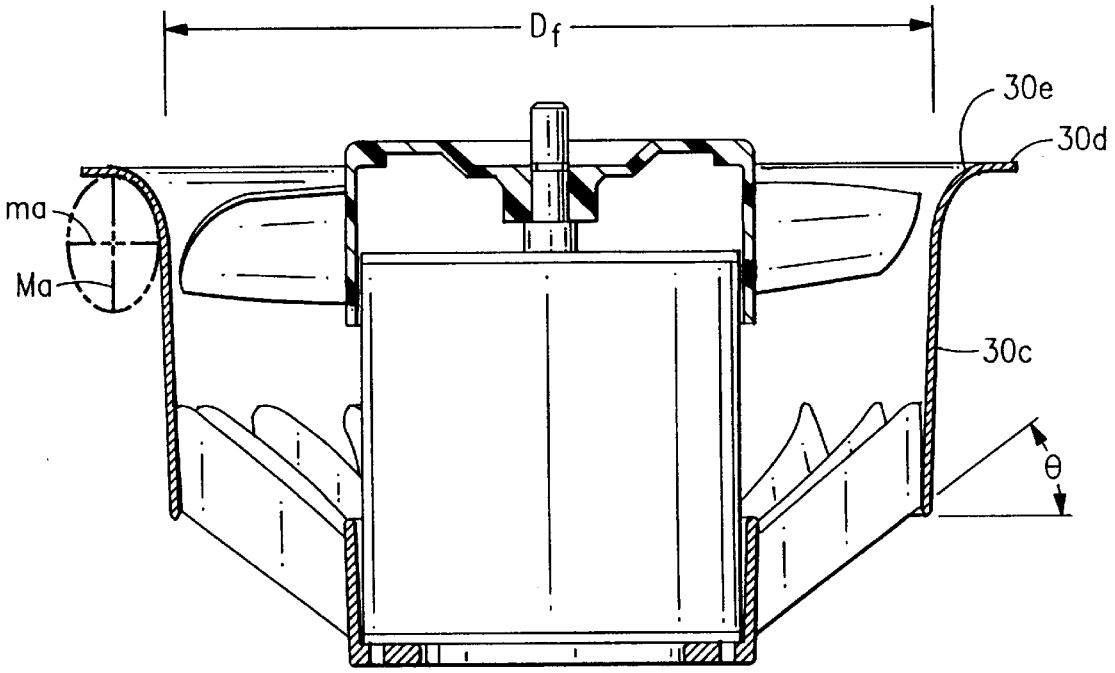
FIG. 2 is a cross-sectional view taken through line 2—2 of FIG. 1.

FIG. 2 is a cross-sectional view taken through line 2—2 of FIG. 1, and shows that housing 30 has a substantially cylindrical side wall portion 30*c* defining a majority of its axial height, a substantially planar end wall portion 30*d* defining the uppermost surface of housing 30, and a curved wall portion 30*e* positioned between side wall portion 30*c* and end wall portion 30*d*. End wall portion 30*d* is arranged substantially perpendicular to side wall portion 30*c*. Curved wall portion 30*e*, when viewed in a cross-sectional plane extending axially through the axis of fan rotation, such as the plane depicted in FIG. 2, is shaped like a quarter ellipse, with its major axis arranged parallel to the axis of fan rotation and its minor axis arranged perpendicular to the axis of fan rotation. It is preferred that the major axis (Ma) of the ellipse equal 0.05–0.15 the diameter of the fan (Df) and the minor axis (ma) of the ellipse equal 0.03–0.1 the diameter of the fan. This provides improved flow of air into the fan assembly.

FIG. 2 also shows the extent to which stator vanes 22 extend downwardly away from outlet end 30*b* of housing 30. Preferably, stator vanes 22 extend axially downwardly from housing 30 by an angle θ ranging from 20 to 45 degrees with respect to a plane arranged perpendicular to the axis of fan rotation. This particular configuration of stator vanes 22 allows the entire length of the casing of motor 31 to be encompassed between inlet end 30*a* of housing 30 and stator hub 21. Preferably, the entire length of the motor casing is encompassed between an axially outermost surface of fan hub 11 and stator hub 21, such that the axially outermost surface of fan hub 11 does not extend beyond end wall portion 30*d* of housing 30.

The overall axial height of the fan assembly is reduced by skewing the stator vanes downwardly to make room for the motor within the housing instead of suspending the motor below the housing as in the prior art fan assembly. The downwardly skewed stator vanes also increase the spacing between the fan blades and the stator vanes, which in turn reduces fan noise by reducing interaction between the fan blades and stator vanes.

FIG. 2 also shows that stator hub 21 is flanged in cross-section to support motor 31. Although it is preferred to bolt motor 31 to stator hub 21, any suitable means could be used.

Figure 3:
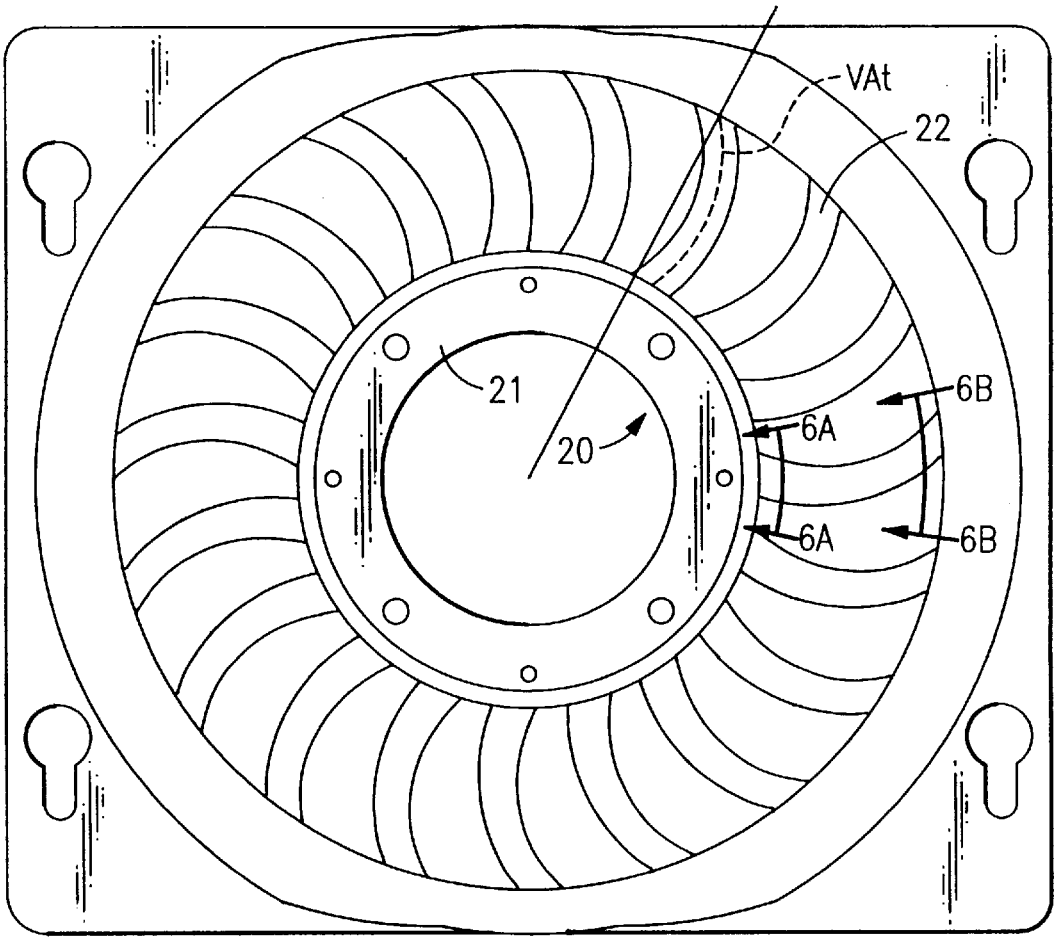
FIG. 3 is a top view of the fan assembly of FIG. 1 with fan 10 and motor 31 removed.

FIG. 3 is a top view of the fan assembly of FIG. 1 with fan 10 and motor 31 removed to show the structure of stator 20. The stator preferably includes a prime number of 11 to 23 vanes, more preferably 17 to 19 vanes, of identical construction. Each vane is swept in the direction opposite to fan rotation, and has a tip sweep angle, VAt, which preferably ranges from 20 to 50 degrees.

Figure 4:
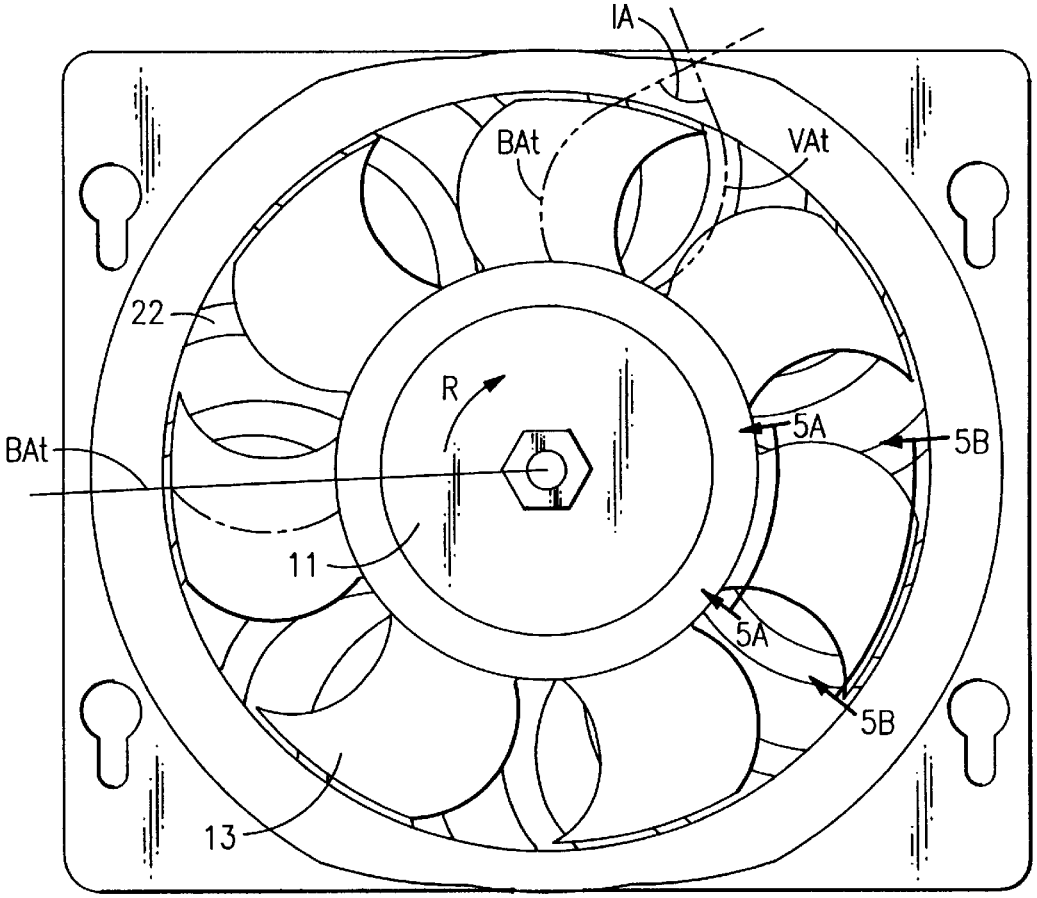
FIG. 4 is a top view of the fan assembly of FIG. 1.

FIG. 4 is a top view of the fan assembly of FIG. 1. Fan 10 is basically the same as the fan described in Amr U.S. Pat. No. 5,273,400, the entirety of which is incorporated herein by reference. The fan preferably includes 5 to 11 blades of identical construction. Each blade is swept backward, with respect to the direction of rotation (R) of the fan, in its root portion and swept forward in its tip portion. Each blade has a tip sweep angle, BAt, which preferably ranges from 50 to 70 degrees.

FIG. 4 also shows the extent of interaction between blades 13 of fan 10 and vanes 22 of stator 20. Each time the tip of a fan blade intersects, when viewed from the top of the fan assembly, the tip of a stator vane, the fan blade is arranged 90 degrees +/− 15 degrees with respect to the stator vane. That is, an interaction angle, IA, formed between tip sweep angle VAt and tip sweep angle BAt ranges from 75 to 105 degrees. When IA falls within this range, the amount of blade/vane interaction is minimized, and consequently, the noise generated by the fan is reduced.

Figure 5A:
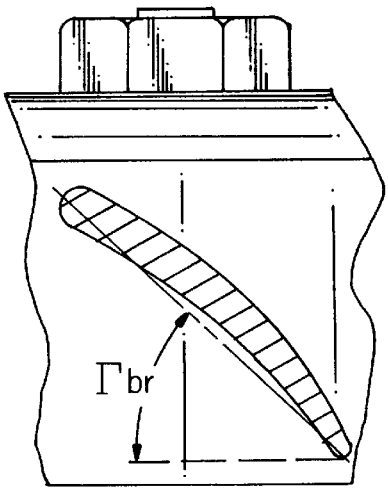
FIG. 5A is a cylindrical cross-sectional view taken through line 5A—5A of FIG. 4
Figure 5B:
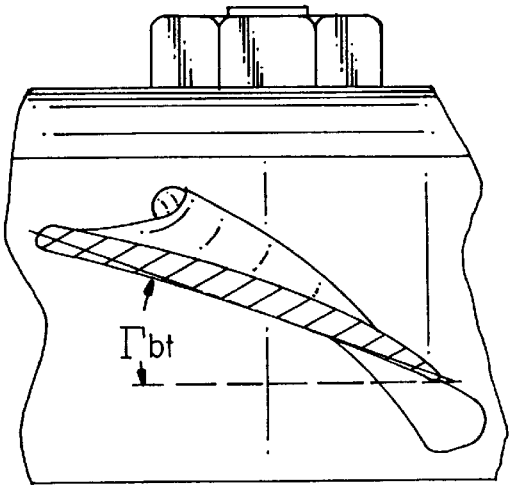
FIG. 5B is a cylindrical cross-sectional view taken through line 5B—5B of FIG. 4.

FIG. 5A is a cylindrical cross-sectional view taken through line 5A—5A of FIG. 4 and shows that blade 13, at its root, has a pitch angle, Γbr. FIG. 5B is a cylindrical cross-sectional view taken through line 5B—5B of FIG. 3 and shows that blade 13, at its tip, has a pitch angle, Γbt. Preferably, Γbr ranges from 60 to 70 degrees and Γbt ranges from 25 to 40 degrees, and the pitch angle varies from the root to the tip.

Figure 6A:
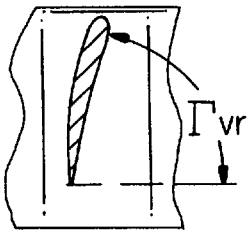
FIG. 6A is a cylindrical cross-sectional view taken through line 6A—6A of FIG. 3
Figure 6B:
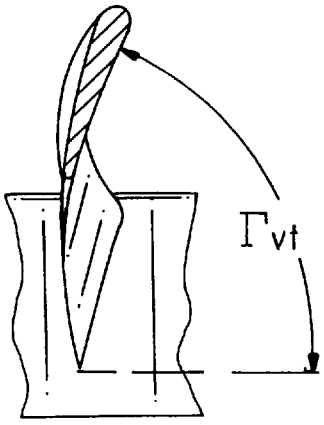
FIG. 6B is a cylindrical cross-sectional view taken through line 6B—6B of FIG. 3.

FIG. 6A is a cylindrical cross-sectional view taken through line 6A—6A of FIG. 3 and shows that vane 22, at its root, has a pitch angle, Γvr. FIG. 6B is a cylindrical cross-sectional view taken through line 6B—6B of FIG. 3 and shows that vane 22, at its tip, has a pitch angle, Δvt (no chord lines are shown in FIGS. 6A and 6*b* in order to preserve clarity). Preferably, Γvr ranges from 60 to 70 degrees and Γvt ranges from 65 to 80 degrees, and the pitch angle varies from the root to the tip.

EXAMPLE

Figure 7:
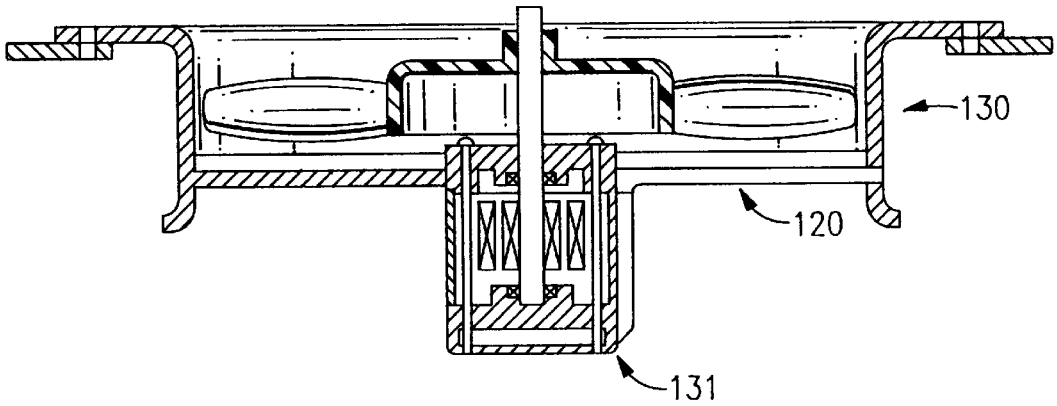
FIG.7 Prior Art
FIG. 7 is a cross-sectional view of a prior art axial flow fan assembly.

An axial flow fan assembly according to the prior art depicted in FIG. 7 was evaluated and compared to an axial flow fan assembly in accordance with the invention to demonstrate the improvements attributable to the fan assembly of the invention. The prior art fan assembly included a fan having 15 blades and a stator having 36 vanes. The overall axial height of the assembly was 11.5 inches and the distance between the fan blades and the stator vanes was less than one fan blade chord length.

The fan assembly according to the invention included a fan having 7 blades each with a tip sweep of 70 degrees and a stator having 19 vanes each with a tip sweep of 30 degrees. The overall axial height of the assembly was 8.5 inches and the distance between the fan blades and the stator vanes was about 2 to 3 fan blade chord lengths. The fan was 6 dBA quieter than the prior art fan assembly.

The fan assembly of the invention has reduced overall height due to the specific construction of the stator vanes and incorporation of the fan motor within the housing. The fan also produces less noise due to the increased spacing between the fan blades and the stator vanes, and due to the specific angular relationship (IA) between the tip sweep angle of the fan blades and the tip sweep angle of the stator vanes.

While the present invention has been described with reference to preferred embodiments thereof, it will be understood by those skilled in the art that various modifications and the like could be made thereto without departing from the spirit and scope of the invention as defined in the following claims.

What is claimed is:

1. An axial flow fan assembly, comprising:

a housing having an inlet at one end thereof and an outlet at the other end thereof;

a stator connected to said housing at said outlet end, said stator comprising a stator hub and a plurality of stator vanes each extending radially inwardly and axially downwardly from said housing and each being connected at its inner tip to said stator hub;

a motor having a casing with a first end and an opposed second end, and a shaft extending from said first end, said motor being positioned within said housing such that said second end is supported by said stator hub, and said first end extends toward said inlet of said housing; and a fan secured to the shaft of said motor, said fan comprising a fan hub and a plurality of fan blades extending substantially radially outwardly from said fan hub;

wherein the entire length of said motor casing is encompassed between the inlet of said housing and said stator hub;

wherein the tip portions of said fan blades are swept in a first direction with respect to the direction of rotation of said fan, and said stator vanes are swept in a second direction opposite said first direction.

2. The axial flow fan assembly of claim 1, wherein the entire length of said motor casing is encompassed between an axially outermost surface of said fan hub and said stator hub.

3. The axial flow fan assembly of claim 1, wherein the tip portions of said fan blades are swept in the direction of fan rotation, and said stator vanes are swept in the opposite direction.

4. The axial flow fan assembly of claim 1, wherein said stator vanes extend axially downwardly from said housing 20–45 degrees with respect to a plane arranged perpendicular to the axis of fan rotation.

5. The axial flow fan assembly of claim 1, wherein said fan includes 5–11 fan blades each having a tip sweep angle of 50–70 degrees with respect to a plane arranged perpendicular to the axis of fan rotation, and said stator includes 11–23 stator vanes each having a tip sweep angle of 20–50 degrees with respect to a plane arranged perpendicular to the axis of fan rotation.

6. The axial flow fan assembly of claim 1, wherein the fan blades have a tip sweep angle and the stator vanes have a tip sweep angle, and an extension of the fan blade tip sweep angle intersects an extension of the stator vane tip sweep angle at an intersection angle ranging from 75 to 105 degrees.

* * * * *